US010190300B2

(12) United States Patent
Guthrie

(10) Patent No.: US 10,190,300 B2
(45) Date of Patent: Jan. 29, 2019

(54) TWO-WAY ADJUSTABLE TOILET FLAPPER VALVE AND ASSEMBLY

(71) Applicant: LAVELLE INDUSTRIES, INC., Burlington, WI (US)

(72) Inventor: Kevin J. Guthrie, Wind Lake, WI (US)

(73) Assignee: Lavelle Industries, Inc., Burlington, WI (US)

( * ) Notice: Subject to any disclaimer, the term of this patent is extended or adjusted under 35 U.S.C. 154(b) by 447 days.

(21) Appl. No.: 13/865,541

(22) Filed: Apr. 18, 2013

(65) Prior Publication Data

US 2014/0059756 A1 Mar. 6, 2014

Related U.S. Application Data

(60) Provisional application No. 61/693,952, filed on Aug. 28, 2012.

(51) Int. Cl.
*E03D 1/30* (2006.01)

(52) U.S. Cl.
CPC ..... *E03D 1/306* (2013.01)

(58) Field of Classification Search
CPC ..... E03D 1/144; E03D 1/306
USPC .... 4/324, 382, 391–393, 399, 400, 415, 669
See application file for complete search history.

(56) References Cited

U.S. PATENT DOCUMENTS 4,189,795 A * 2/1980 Conti ..... E03D 1/142 137/403
4,419,773 A * 12/1983 Sullivan ..... E03D 1/142 137/403
5,195,189 A * 3/1993 Gibb ..... E03D 1/14 4/325
5,390,375 A * 2/1995 Fernstrum, Jr. ..... E03D 1/142 4/393
6,173,457 B1 * 1/2001 Higgins ..... 4/393
6,381,765 B1 * 5/2002 Liu ..... 4/404
6,651,265 B2 * 11/2003 Kwen ..... 4/404
7,222,375 B2 * 5/2007 Chen ..... E03D 1/142 4/404
2008/0244818 A1 * 10/2008 Li ..... E03D 1/306 4/393
2008/0271233 A1 * 11/2008 Han ..... E03D 1/306 4/324

* cited by examiner

*Primary Examiner* — David Angwin
*Assistant Examiner* — Nicholas Ros
(74) *Attorney, Agent, or Firm* — Joseph S. Heino; Erin E. Kaprelian

(57) ABSTRACT

An improved flapper valve has an elastomeric surrounding flapper valve top. A separate inverted dome-like structure, or cone, which is the ballast, is included for insertion into the flapper valve top. The improved flapper valve further includes a ring-like upper structure and a cap-like bottom structure. The ring-like upper "vent band" structure rotates about the cone relative to an air outlet aperture defined in the cone to control air flow from the cone. The bottom cap-like "adjuster" structure also rotates about the bottom of the cone to control water flow into the cone, also via apertures in both structures. Used together, the upper and bottom structures can minimize water consumption by the toilet. Further, the adjuster structure includes means for discretely changing settings with indicia to indicate to the user what the current setting is and means for maintaining that setting as may be desired or required.

18 Claims, 13 Drawing Sheets

TWO-WAY ADJUSTABLE TOILET FLAPPER VALVE AND ASSEMBLY

This Application claims the benefit of U.S. Provisional Application No. 61/693,952, filed Aug. 28, 2012.

FIELD OF THE INVENTION

The present invention relates generally to indoor plumbing and gravity-operated flush toilets. More particularly, the present invention relates to flapper valves that are used in such toilets and to an improved flapper valve and assembly of the type that has a ballast built into it which is two-way adjustable relative to the flow of water into the ballast and to the flow of air from the ballast.

BACKGROUND OF THE INVENTION

Conventional gravity-operated flush toilets have several basic components. The porcelain or china components include a bowl and a water tank mounted on top of a rear portion of the bowl. The bowl and tank can be separate pieces bolted together to form a two-piece toilet. Other gravity-operated flush toilets are made as a one-piece toilet in which the bowl and tank are made as one continuous integral piece of china.

More importantly, the plumbing components of a gravity-operated flush toilet include a fill valve in the tank which is connected to a water supply line, a flush valve surrounding a drain hole in the bottom of the tank that communicates with the bowl, and a flapper valve that normally closes and seals the flush valve or, more precisely, the main flush valve orifice.

Toilet flapper valves are typically formed as a single structure having a rim for sealing the main flush valve orifice with the flapper valve rim following flushing. The flapper valve is often formed of a soft elastomeric material and is hinged to allow the valve to be pivotally moved upwardly and away from the main flush valve orifice by means of a chain that is connected to the flush handle on the outside of the tank. Once the tank empties, the flapper valve then returns to a position where it seals the main flush valve orifice, the rim of soft elastomeric material forming a sealing area about that main flush valve orifice.

Such toilet flapper valves are also typically formed to include a ballast structure which is a dome-like or cone-shaped structure disposed within the rim of the flapper valve and which controls the buoyancy of the flapper valve. The buoyancy of a flapper valve is an important function because it determines how much or how little water is used to empty the water tank upon flushing, thus creating water conservancy issues. The buoyancy of the flapper valve is determined by how quickly air is allowed to escape from the ballast.

Therefore, one way that the buoyancy of the flapper valve ballast can be controlled is by controlling the rate at which air within the ballast can flow out of the ballast. This can be done by creating and/or adjusting the size of an aperture at a point within the flapper valve ballast. Another way that the buoyancy of the flapper valve ballast can be controlled is by controlling the rate at which water can flow back into the ballast.

In the experience of this inventor, flapper valves of current manufacture do not provide an easy-to-use and two-way adjustable flapper valve which combines both functionalities into a single structure.

SUMMARY OF THE INVENTION

Accordingly, a primary objective of the device of the present invention is to provide a new, useful and non-obvious improved toilet flapper valve that can be used to cover and seal the main flush valve orifice, which flapper valve comprises two-way adjustment capabilities. One adjustment allows the flapper valve to include a variably-adjustable air outlet capability. Another adjustment allows the flapper valve to include a variably-adjustable water inlet capability. Together, the two-way adjustment of the improved flapper valve improves performance of the toilet flush valve by allowing the user to use the two-way adjustment to separately control water flow into the ballast of the flapper valve and control air flow out of the ballast and to balance those two functionalities across a very wide range of 2 inch flushing toilets of current manufacture.

More specifically, it would be desirable to provide such an improved flapper valve that can be used and is adjustable for use with 2 inch flushing toilets ranging from 1.2 gallons per flush to 7.0 gallons per flush. It is another object to provide such a two-way adjustable flapper valve that is made of the same soft elastomeric material that is used in flapper valves of current manufacture. It is yet another object to provide such a flapper valve that utilizes an elastomeric portion comprised of real rubber material having chemical resistance capabilities whereby the flapper valve is still allowed to conform to the seating surface of the main flush valve orifice and separately-attachable elements for creating the two-way adjustment about the ballast structure.

In accordance with the aforementioned objectives of the present invention, there is provided an improved flapper valve having an elastomeric surrounding flapper valve top. A separate inverted dome-like structure, or cone, which is the ballast, is included for insertion into the flapper valve top. The improved flapper valve further includes a ring-like upper structure and a cap-like bottom structure. The ring-like upper "vent band" structure rotates about the cone relative to an air outlet aperture in the cone to control air flow from the cone. The bottom cap-like "adjuster" structure also rotates about the bottom of the cone to control water flow into the cone. Used together, the upper and bottom structures can minimize water consumption by the toilet. Further, the adjuster structure includes means for discretely changing settings with indicia to indicate to the user what the current setting is and means for maintaining that setting as may be desired or required. Additionally, the hinge portion of the flapper valve of the present invention allows stable pivoting while being easily removable and allowing easy attachment onto the flush valve peg hooks of conventional toilets.

The flapper valve of the present invention is believed, by this inventor, to have the widest range in "gallons per flush" (or "gpf") capacity. More specifically, the flapper valve of the present invention is adjustable from 1.2 to 7.0 gpf which means that it would work on 1.28, 1.6, 3.0, 3.5, 5.0 and 7.0 gpf toilets.

The foregoing and other features of the two-way adjustable flapper valve of the present invention will be apparent from the detailed description that follows.

DETAILED DESCRIPTION

Figure 1:
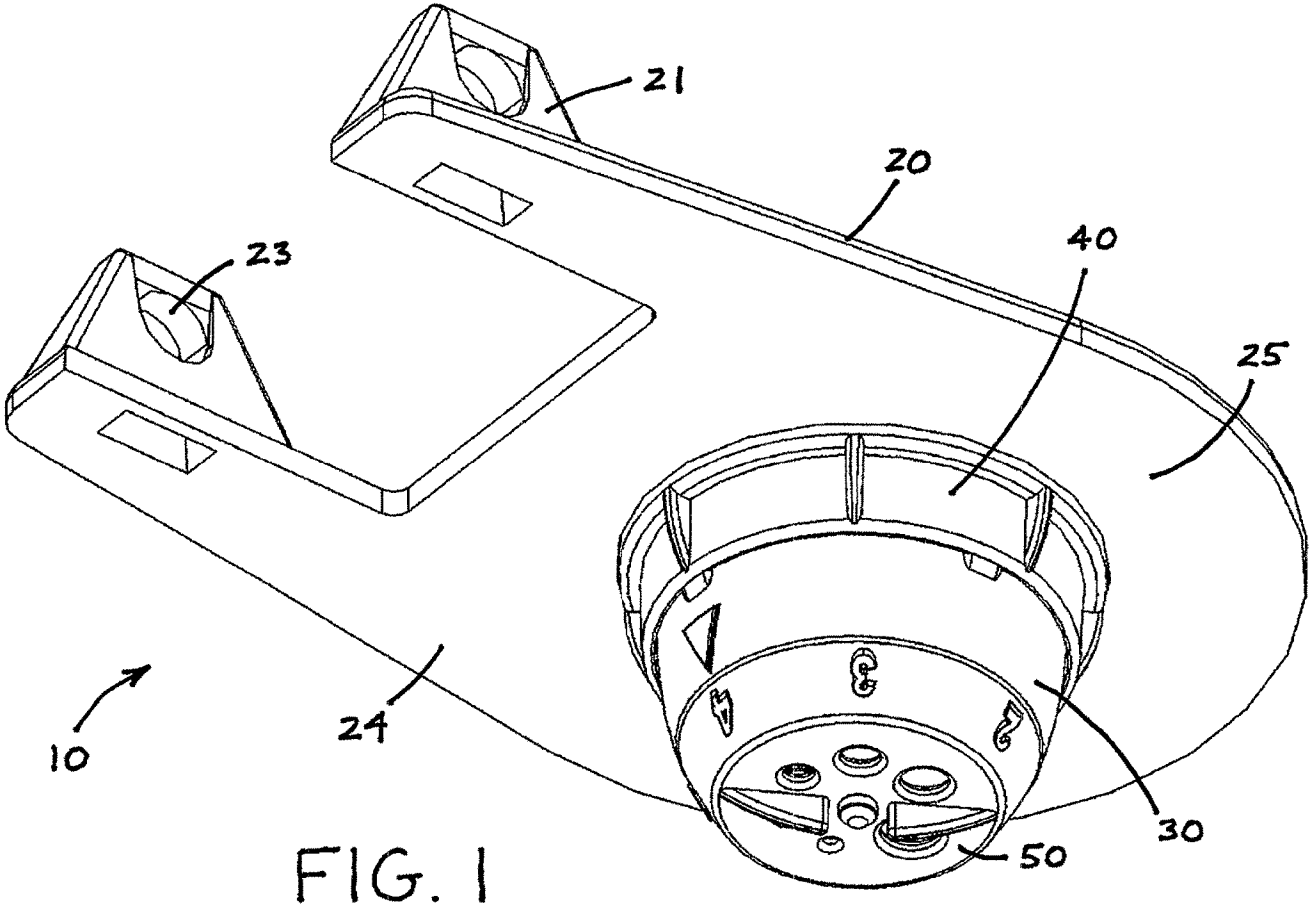
FIG. 1 is a bottom, rear and left side perspective view of one embodiment of an improved flapper valve that is constructed in accordance with the present invention.
Figure 2:
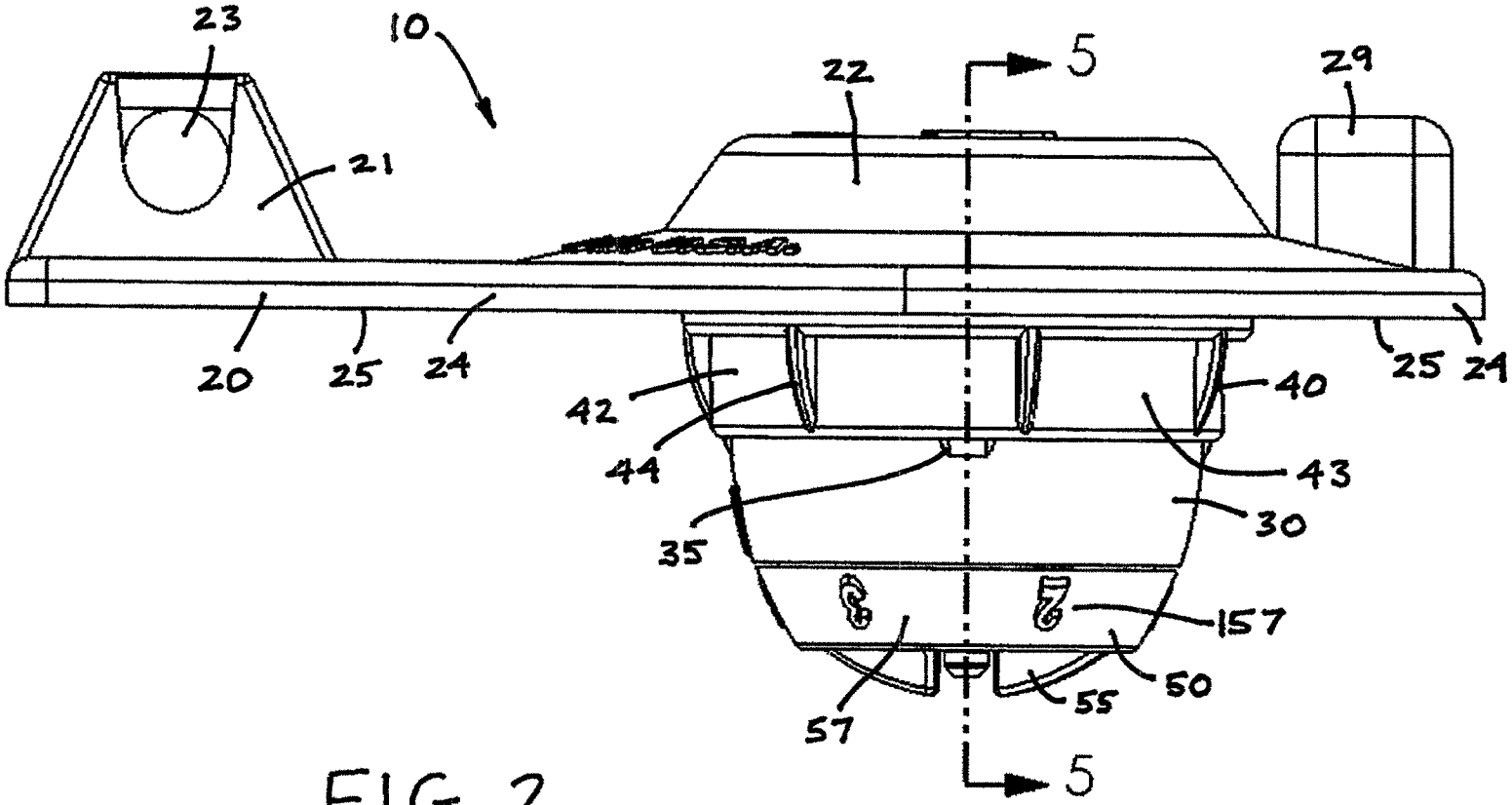
FIG. 2 is an enlarged left side perspective view of the flapper valve shown in FIG. 1.
Figure 3:
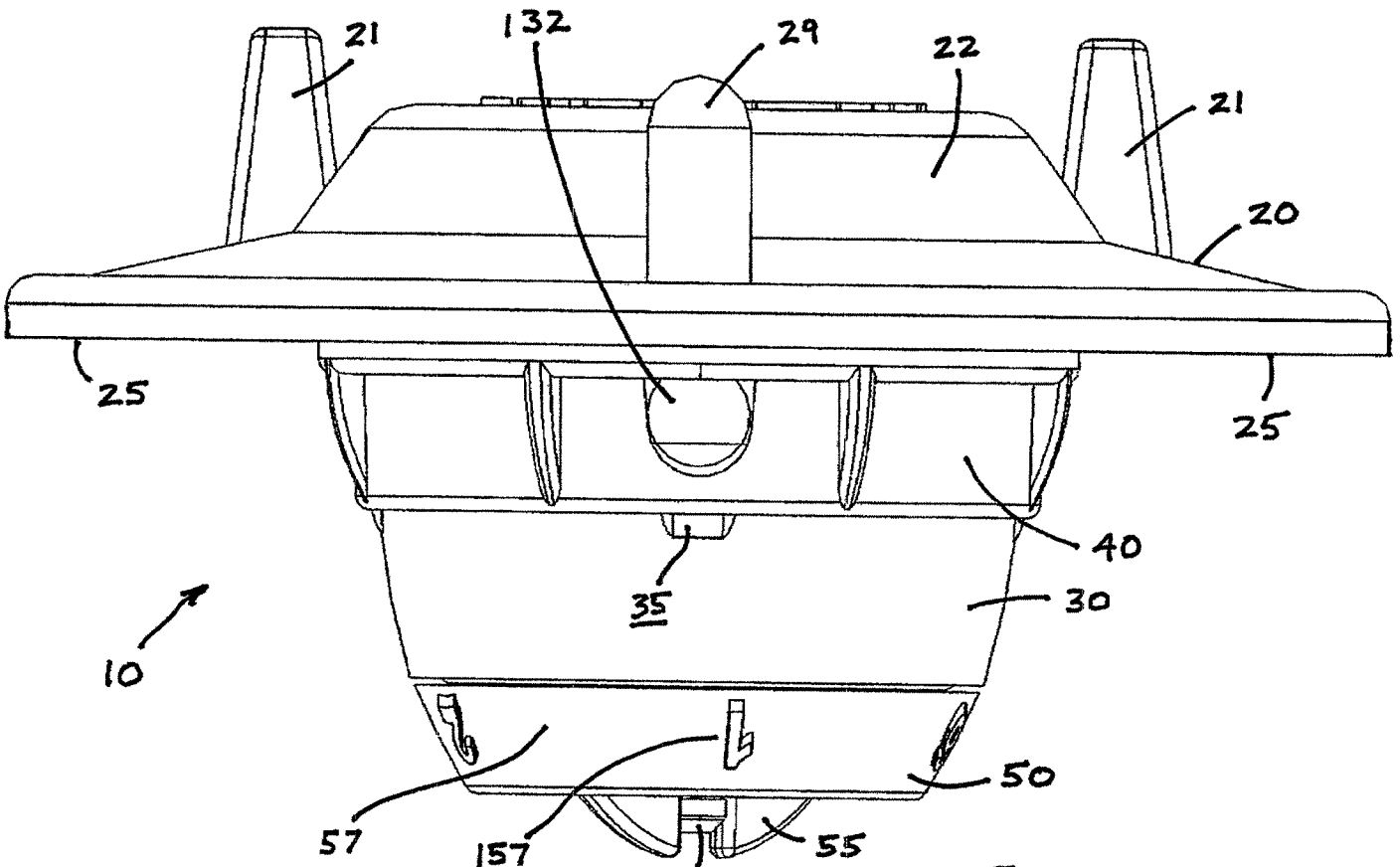
FIG. 3 is a front elevational view of the flapper valve shown in FIG. 1.
Figure 4:
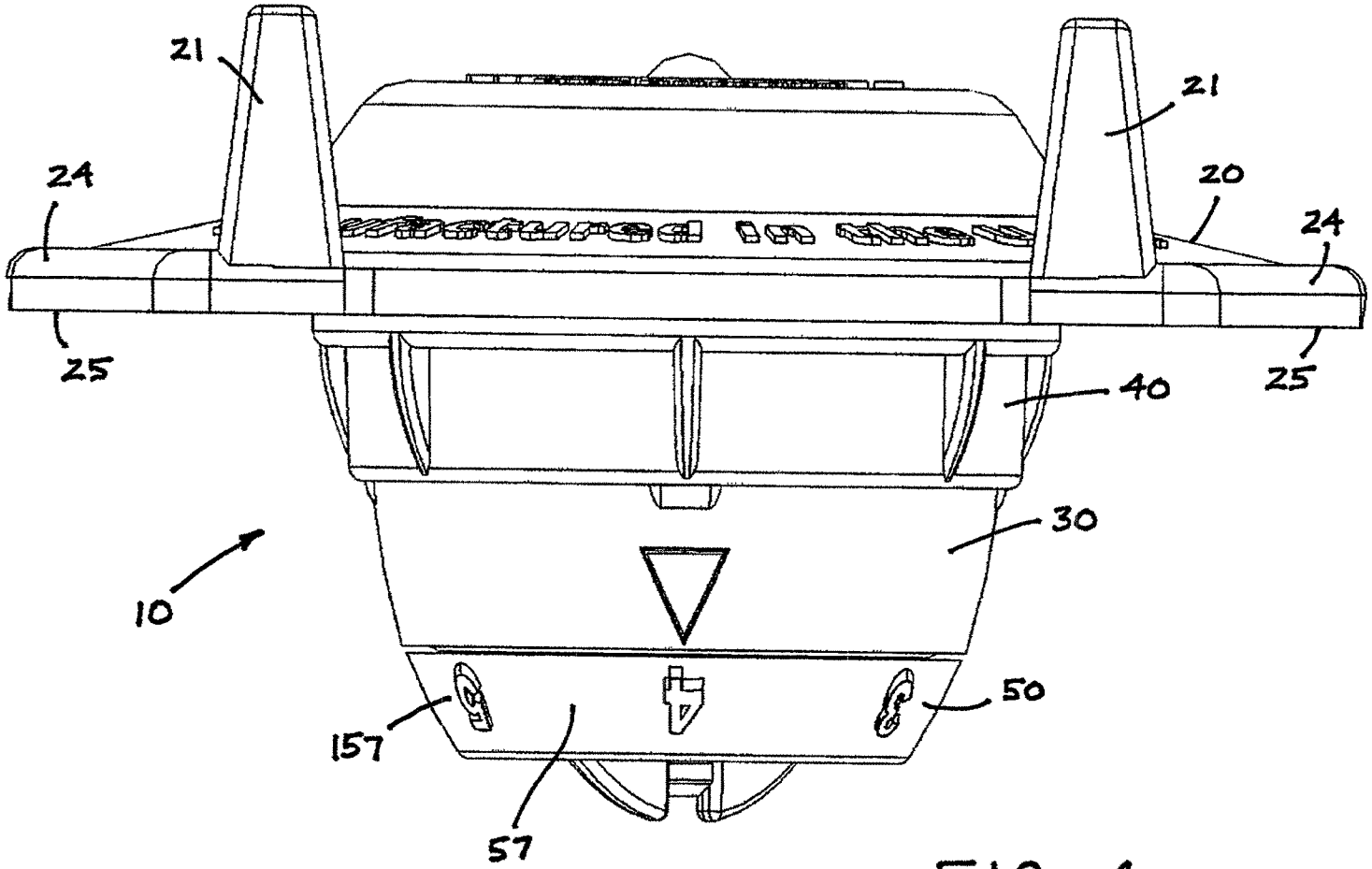
FIG. 4 is a rear elevational view of the flapper valve shown in FIG. 1.

Referring now to the drawings in detail, wherein like-numbered elements refer to like elements throughout, FIGS. 1 through 18 illustrate a preferred embodiment of an improved flapper valve, generally identified 10, that is constructed in accordance with the present invention. The improved flapper valve 10 is the type that is intended to be used with a toilet flush valve and main flush valve orifice (not shown). As illustrated in FIGS. 1-10 and 15, the improved flapper valve 10 is comprised of four primary elements: a flapper top 20, a stationary cone 30, a rotatably-movable vent band 40 disposed toward the top of the cone 30, and a rotatably-movable snap-fit cap-like adjuster 50 disposed toward the bottom of the cone 30.

The flapper top 20 is typically made of an elastomeric material such as real or synthetic rubber having a suitable durometer or softness. In the preferred embodiment, the flapper top 20 is comprised of a real rubber material for suitable sealing and is resistant to chemicals by virtue of a CHLORAZONE® additive (CHLORAZONE is a registered trademark of Lavelle Industries, Inc.). The flapper top 20 has an upper inverted cup-shaped portion 22. See FIGS. 2 through 5. Extending rearwardly of the cup-shaped portion 22 is a pair of spaced apart parallel mounting arms 21 with rear ends that include apertures 23, the apertures 23 being used to rotatably connect the flapper valve 10 to pegs (not shown) that form part of the flush valve (also not shown). See also FIG. 2. Forwardly of the cup-shaped portion 22 is a connection ridge 29. The connection ridge 29 typically includes an aperture (not shown) to receive a hook and chain-like structure (also not shown) for lifting the flapper valve 10 upwardly during the initiation of the flush cycle of the toilet. Extending about the periphery of the flapper top 20 is an annular peripheral flange or lip 24 having an underside 25 that sits on, or sealingly mates with, the valve seat (also not shown) of the main flush valve orifice. Extending inwardly of the underside 25 of the peripheral lip 24 is a circumferential captive portion 27. See FIG. 5. The captive portion 27 of the flapper top 20 is configured to receive a portion of the cone 30 within a first groove 26 and a portion of the vent band 40 within a second groove 28, as will be apparent below. The first groove 26 comprises a polarizing tab 126 that is defined in the rearward captive portion 27 of the flapper top 20, as will also be apparent below. See FIGS. 12 and 16.

The cone 30 is a stationary structure. See FIGS. 1-14. That is, the cone 30 does not rotate relative to the flapper top 20. The cone 30 comprises a cup-like structure defining a hollow cone cavity 130. The cone 30 further comprises a substantially planar and horizontal upper cone edge 36. The upper cone edge 36 is captured within and held in place by the first groove 26 of the captive portion 27 of the flapper top 20. The cone 30 further comprises an upper cone wall 32 having an outer surface 31, a central cone wall 34 having an outer surface 33, a lower cone wall 38 having a recessed outer surface 37 and a slightly flanged lower cone wall finger 39 extending downwardly from the outer surface 37 of the recessed lower cone wall 38. The cone 30 further comprises a polarizing recess 136 defined within a rearward portion of the substantially planar and horizontal upper cone edge 36 to ensure proper positioning relative to the cone 30 and the flapper top 20. See FIGS. 8 and 9. This positioning is accomplished by means of the polarizing recess 136 that is configured to receive the polarizing tab 126 that is defined in the rearward captive portion 27 of the flapper top 20. See FIG. 16. The cone 30 further comprises a plurality of cone snap tabs 35 extending outwardly from the outer surface 31 of the upper cone wall 32. See FIGS. 11-13. The snap tabs 35 are used to maintain the vent band 40 in a position such that the band 40 is rotatable about the upper cone wall 32 but is not able to move vertically relative to that wall 32. The upper cone wall 32 further comprises a front aperture 132. See also FIGS. 3, 10, and 13. The outer surface 31 of the upper cone wall 32 further comprises an outwardly-protruding vent band positioning nub 131 that will alternatively mate with and disengage from complementary structures defined within the vent band 40 so as to maintain the circumferential position of the vent band 40 relative to the cone 30 but also allow the position of the vent band 40 to be changed relative to the cone 30. The specific structure of the vent band 40 that is complementary to the positioning nub 131 is a vent band detent 141. See FIGS. 8 and 9. The vent band 40 is movable 360° about the cone wall 32 but is preferably disposed about the cone wall 32 in one of two primary circumferential positions, as will be explained later in this detailed description. Lastly, the lower cone wall portion 38 comprises a bottom aperture 138. See FIGS. 8, 9, and 12-14. It will be appreciated that the bottom aperture 138 is positioned 180° opposite the front aperture 132 and is disposed at the rearward portion of the cone 30, the front aperture 132 being disposed at the forward portion of the cone 30. See FIGS. 12 and 13. The two apertures 132, 138 in the cone 30 have been found by this inventor to allow for the quickest and highest volume removal which makes the flapper 10 fall quickly and is preferred for use in 1.28 and 1.0 gallon-per-flush toilets. The outer surface 37 of the lower cone wall 38 further comprises an outwardly-protruding adjuster positioning nub 139, the adjuster positioning nub 139 being configured to mate with complementary structures defined within the adjuster 50 to maintain the circumferential position of the adjuster 50 relative to the cone 30, as will be described later in this detailed description.

Figure 5:
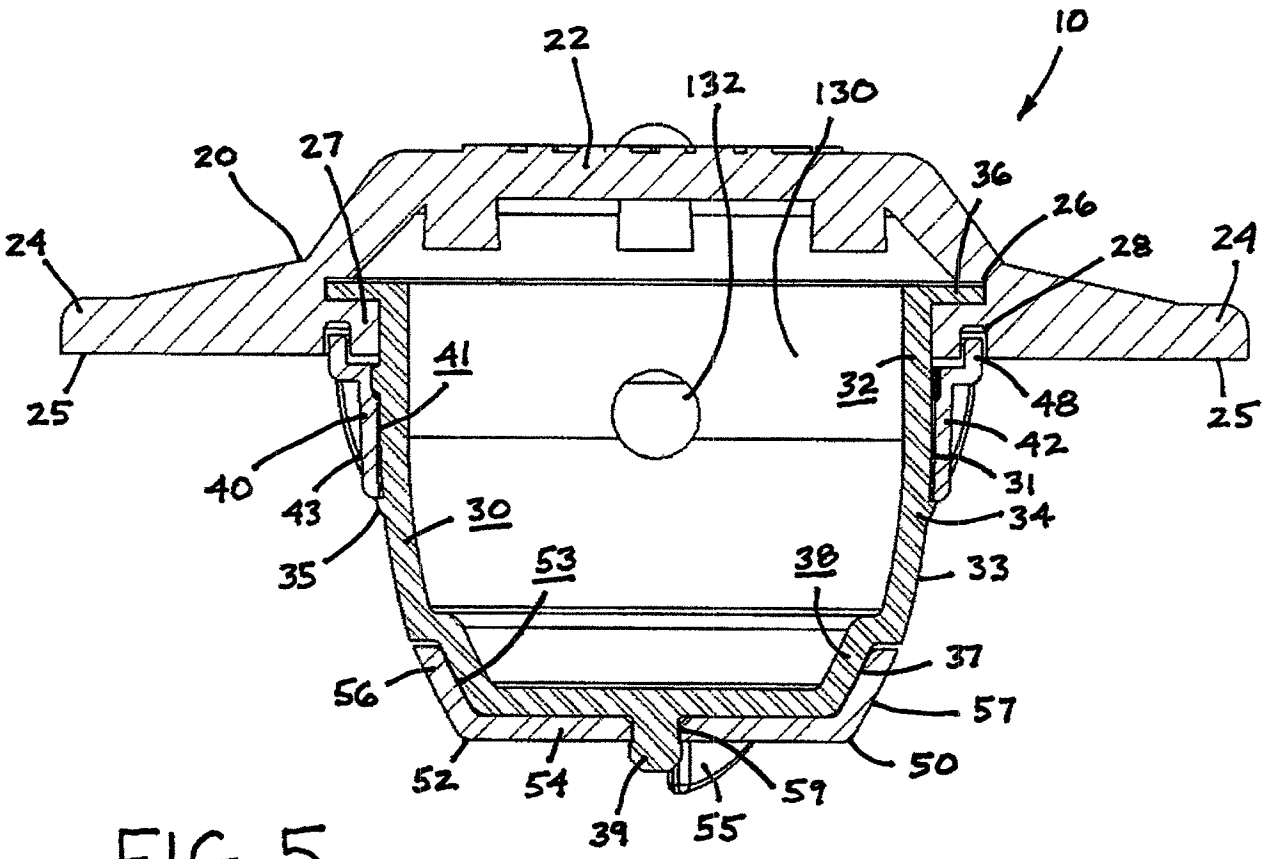
FIG. 5 is a cross-sectioned front elevational view of the flapper valve shown in FIG. 1 taken along line 5-5 of FIG. 2.
Figure 6:
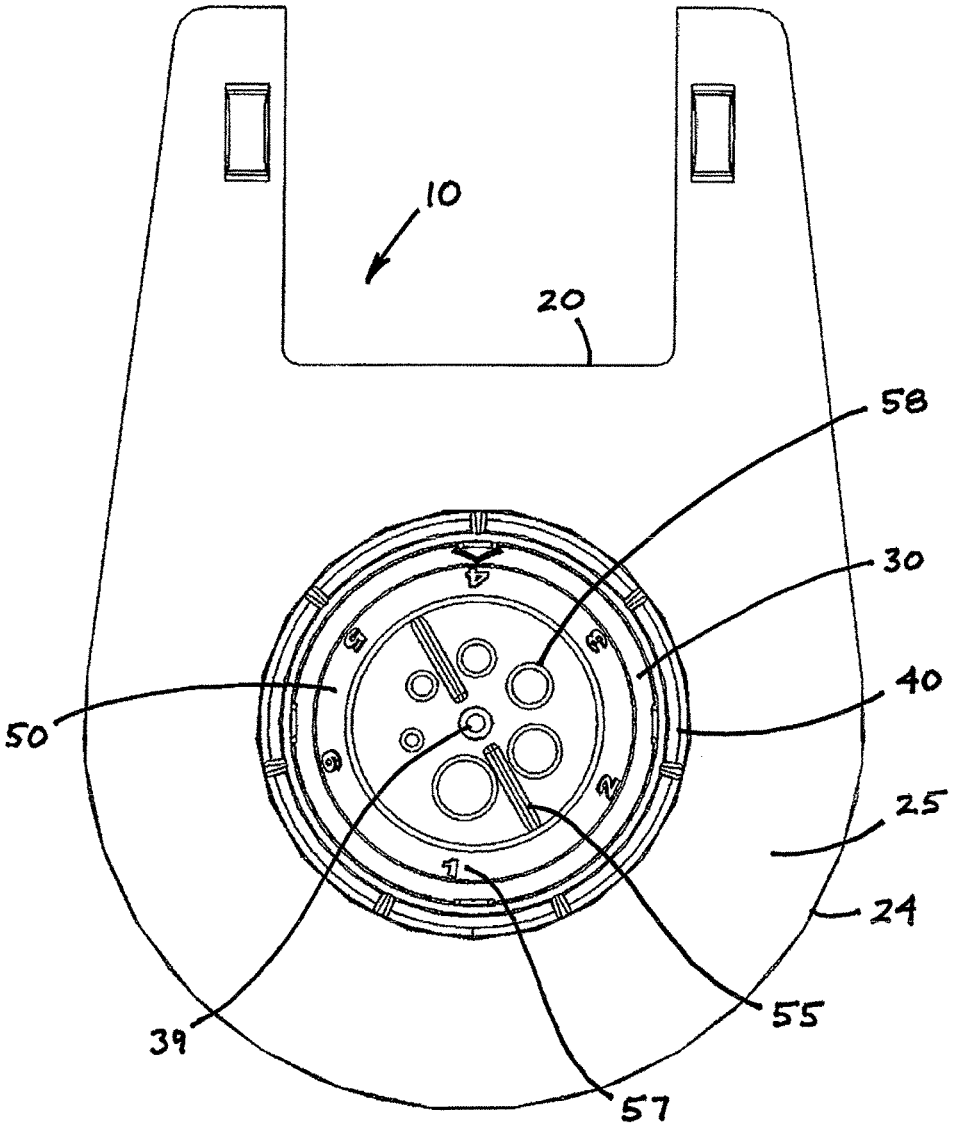
FIG. 6 is a bottom plan view of the flapper valve shown in FIG. 1.
Figure 7:
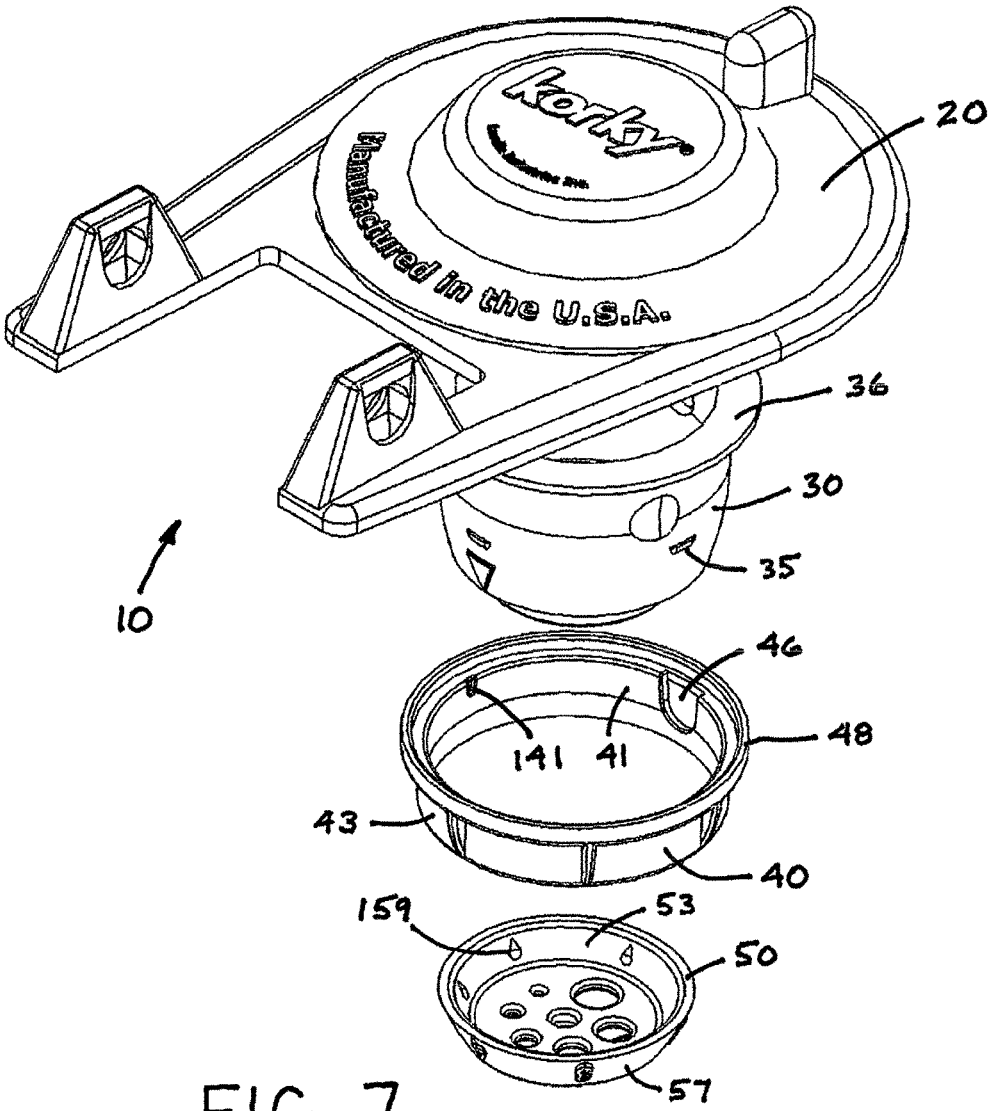
FIG. 7 is an exploded top, rear and left side perspective view of the flapper valve shown in FIG. 1.
Figure 8:
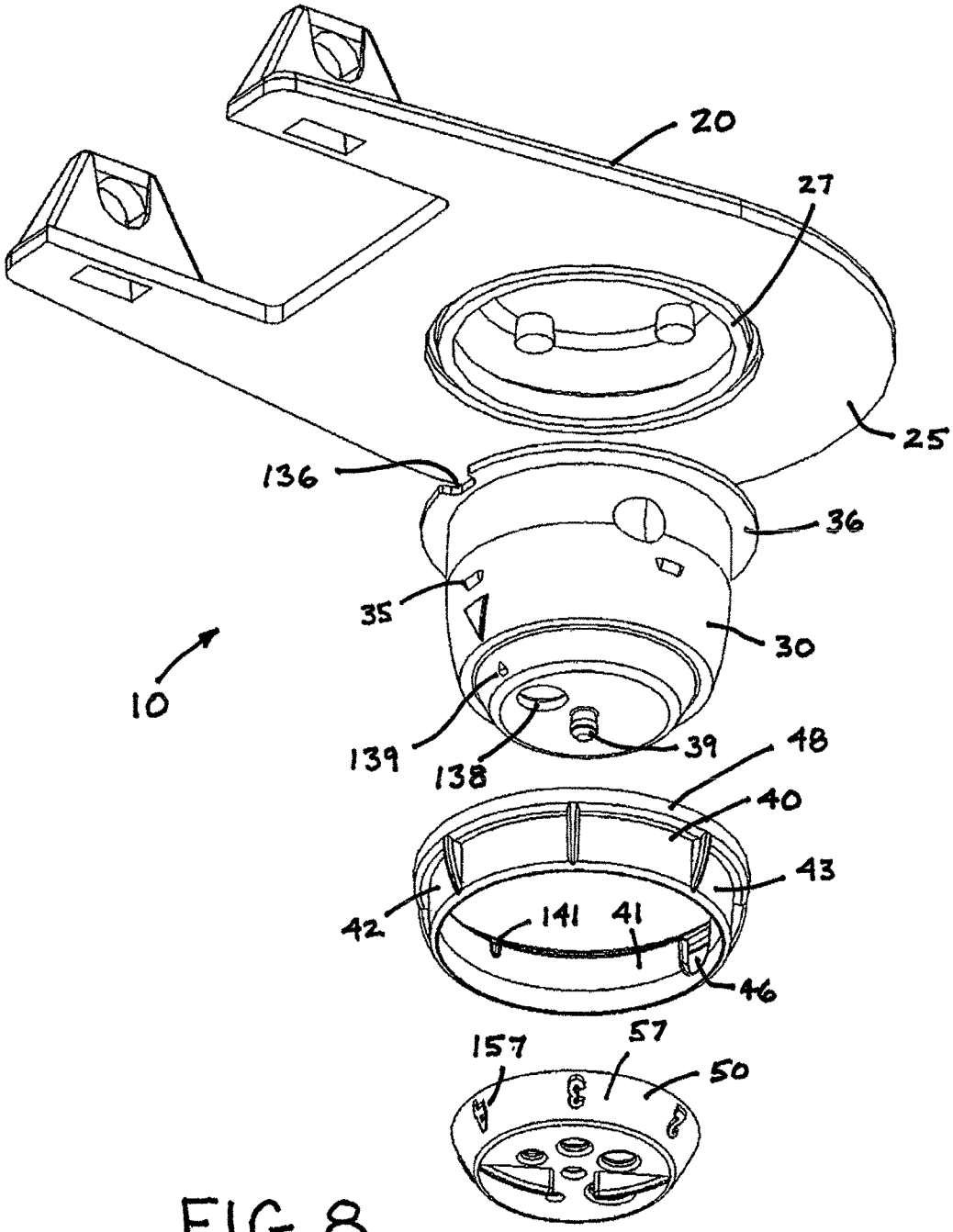
FIG. 8 is an exploded bottom, rear and left side perspective view of the flapper valve shown in FIG. 1.
Figure 9:
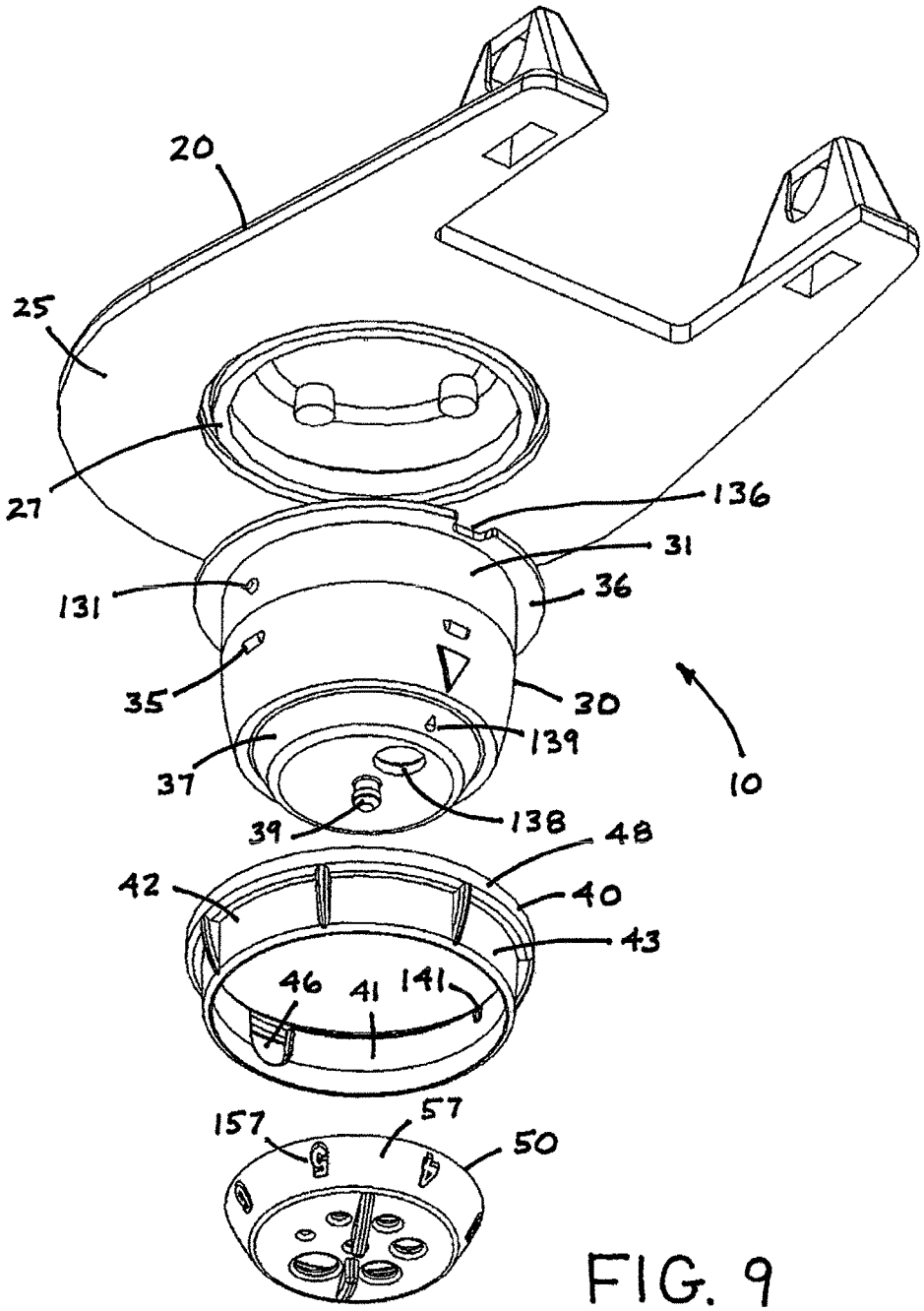
FIG. 9 is an exploded bottom, rear and right side perspective view of the flapper valve shown in FIG. 1.
Figure 10:
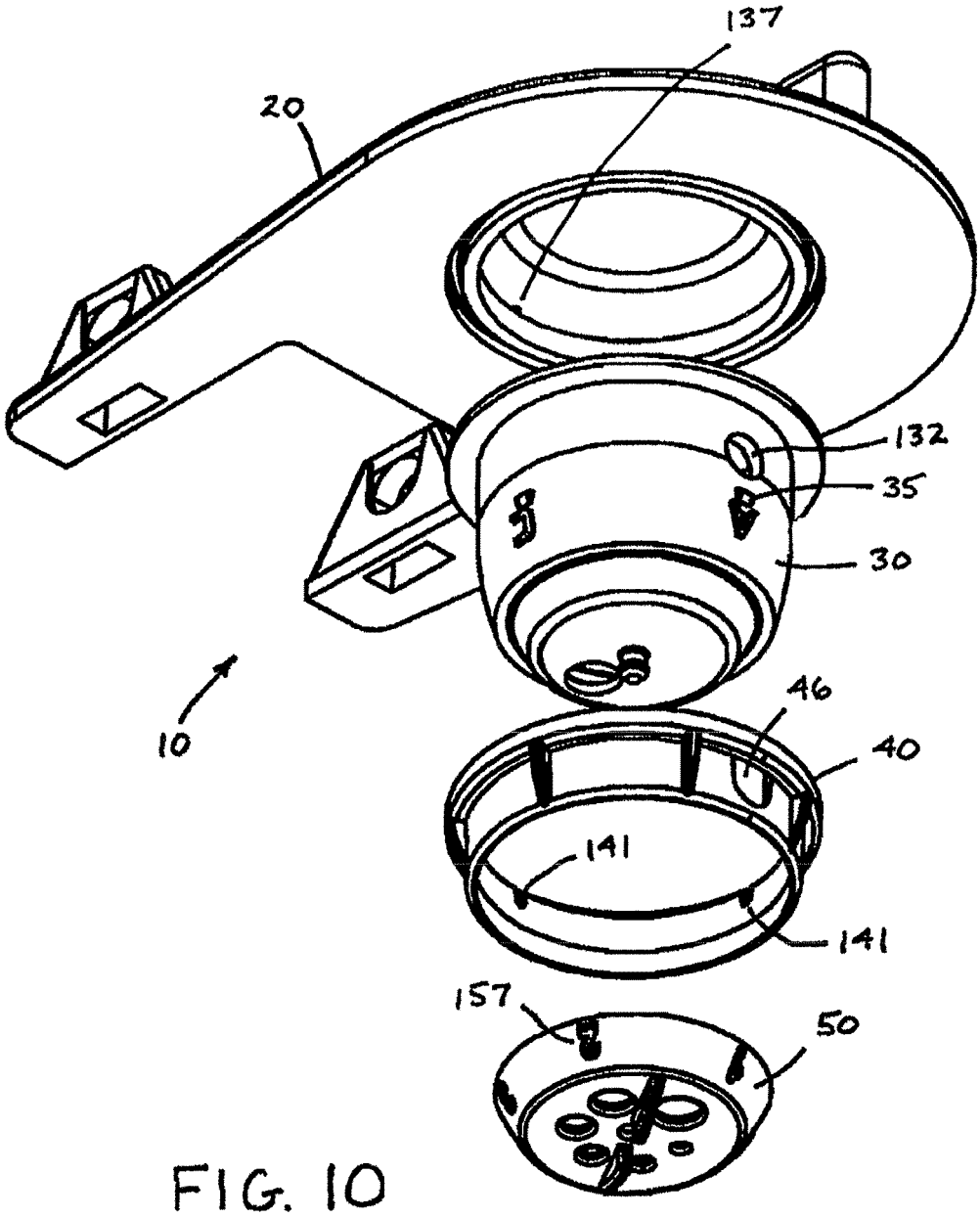
FIG. 10 is an exploded bottom, front and left side perspective view of the flapper valve shown in FIG. 1.
Figure 11:
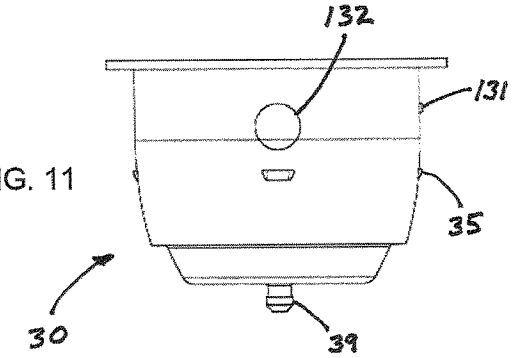
FIG. 11 is a front elevational view of the cone of the flapper valve in accordance with the present invention.
Figure 12:
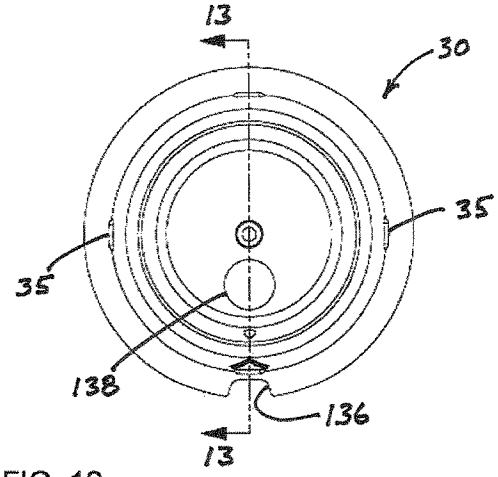
FIG. 12 is a bottom plan view of the cone shown in FIG. 11.
Figure 13:
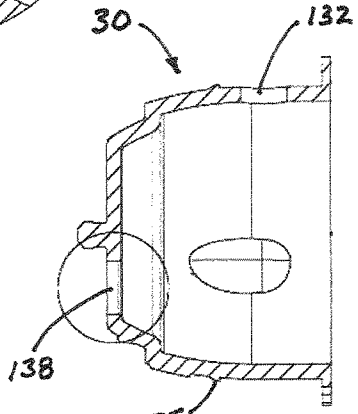
FIG. 13 is a cross-sectioned side elevational view of the cone shown in FIG. 11 and taken along line 13-13 of FIG. 12.
Figure 14:
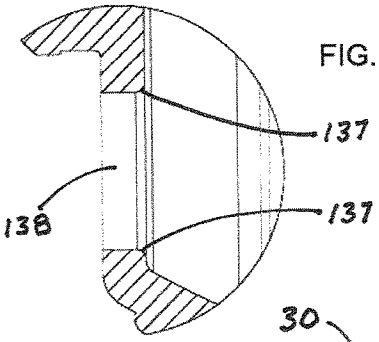
FIG. 14 is a greatly enlarged view of the aperture that is defined in the bottom of the cone shown in FIG. 13.
Figure 16:
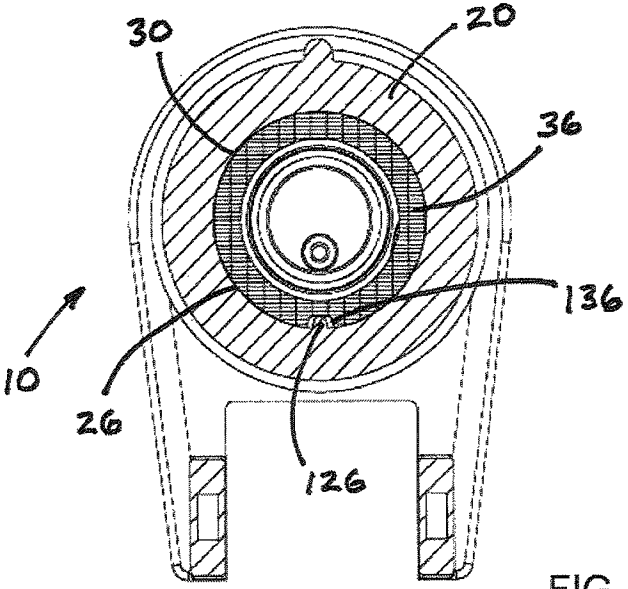
FIG. 16 is a cross-sectioned top plan view of the flapper valve shown in FIG. 1 taken along line 16-16 of FIG. 15.
Figure 15:
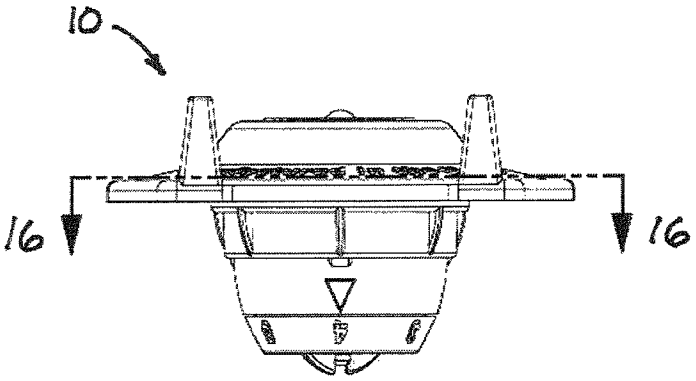
FIG. 15 is a rear elevational view of the flapper valve shown in FIG. 1.

The rotating vent band 40 comprises a flat ring-like structure comprising a cylindrical band body 42 having an inner surface 41, an outer surface 43, an upper band body lip 48 and a plurality of support ribs 44. As shown in FIG. 5, the upper band body lip 48 is receivable within the second groove 28 of the captive portion 27 of the flapper top 20, the band body 42 further being rotationally-movable about the outer surface 31 of the upper cone wall 32 of the cone 30. The vent band body 42 further comprises a substantially circular aperture 46. The vent band body 42 is rotatable to place the aperture 46 in one of two positions. Specifically, the aperture 46 can be placed in a first position where it overlays the front aperture 132 of the cone 30 and in a second position where it does not overlay that front aperture 132. The support ribs 44 are provided to add strength to the vent band 40 and act as tactile structures that allow the user to grasp and then rotate the vent band 40 in accordance with the desired setting. Lastly, the inner surface 41 of the vent band body 42 comprises a plurality of detents 141 that are each configured to mate with a vent band positioning nub 131. See FIGS. 7 and 9. As the vent band 40 is rotated about the cone 30, the vent band positioning nub 131 and detents 141 allow the band 40 to "locate" or "cog" to a position that is desired or required by a user, such position being consistent with the positions mentioned above.

Figure 18:
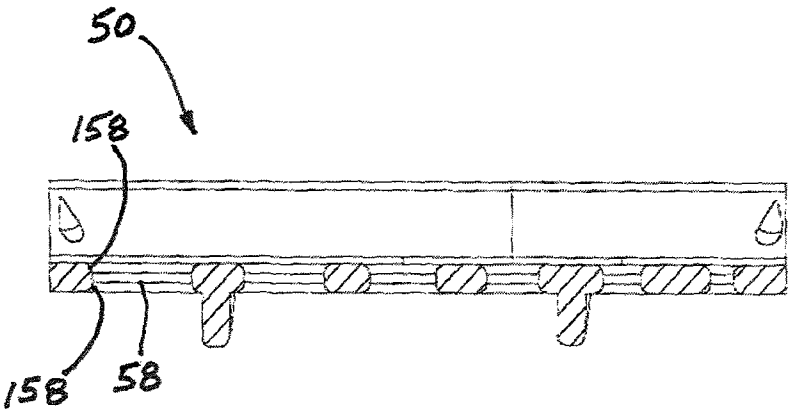
FIG. 18 is a further enlarged and cross-sectioned side elevational view of the cone adjuster shown in FIG. 17 and taken along line 18-18 of FIG. 17.
Figure 17:
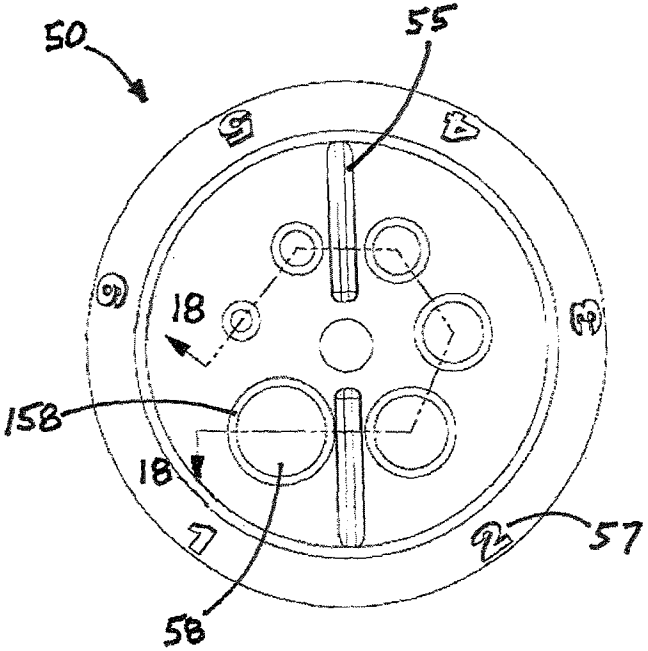
FIG. 17 is an enlarged bottom plan view of the cone adjuster of the flapper valve in accordance with the present invention.

The snap-fit bottom adjuster 50, which is also rotatably-movable relative to the cone 30, comprises a shallow cup-like structure having a circular body 52 with a bottom portion 54 and an upwardly-extending shallow side wall 56, the side wall 56 having an inner surface 53 and an outer surface 57. See FIGS. 5, 7,17, and 18. The adjuster 50 further comprises a primary or mounting aperture 59 that is a centrally-disposed within the bottom portion 54 of the adjuster 50. This mounting aperture 59 is attachable to the lower wall finger 39 of the cone 30 which allows the adjuster 50 to rotate about that finger 39. A plurality of variably-sized secondary apertures 58 are also disposed within the bottom portion 54 of the adjuster 50, the secondary apertures 58 being variably positioned relative to the aperture 138 that is defined within the lower cone wall portion 38 of the cone 30 when the adjuster 50 is rotated. See FIG. 6. In the preferred embodiment, six differently-sized circular secondary apertures 58 are provided to give the user the ability to choose from multiple settings for the water out-flow from the cone cavity 130. The relative diameters of the secondary apertures 58 are best illustrated in FIGS. 17 and 18. Tactile members 55 extend downwardly from the bottom portion 54 of the adjuster 50 to allow the user to grasp the adjuster 50 and twist it into a desired position relative to the aperture 138 that is defined within the lower cone wall 38. Adjuster indicia 157 are defined within the outer surface 57 of the side wall 56 to give the user visual confirmation as to the aperture 58 settings made by the user. Lastly, the inner surface 53 of the adjuster 50 comprises a plurality of detents 159 that are each configured to mate with an adjuster positioning nub 139. See FIGS. 7 and 8. As the adjuster 50 is rotated about the cone 30, the adjuster positioning nub 139 and detents 159 allow the adjuster to "locate" or "cog" the adjuster to position that is desired or required by the user, such position being consistent with the adjuster indicia 157.

It should also be mentioned here that the bottom aperture 138 of the cone 30 is configured with an internal radius 137. See FIGS. 8, 10, 11 and 12. This internal radius 137 is provided to allow for improved water flow dynamics due to improved water drainage out of the cone 30. Similarly, each of the variably-sized secondary apertures 58 of the adjuster 50 is configured with a radius 158 on both sides of the aperture 58. The radii 158 of the secondary apertures 58 allow a true hole size such that no air eddies are present, such as would be the case when water passes over a sharp edge. The internal radii 158 of the apertures 58 allow for proper drainage from the cone 30 with no water retention as would be the case if the apertures 58 were configured with a sharp edge. In the preferred embodiment, the diameter of the bottom aperture 138 of the cone 30 is 0.250 inches whereas the diameter of the largest secondary aperture 58 of the adjuster 50 is 0.210 inches. For this reason, the bottom aperture 138 of the cone 30 only requires an internal radii 137 as water will flow over that inner radii and then over the radii 158 of the secondary apertures 58, the outer bottom surface of the cone 30 being juxtaposed to the inner surface of the adjuster 50.

The details of the invention having been disclosed in accordance with the foregoing, I claim:

1. A flapper for use with a toilet flush valve, the flush valve comprising a main flush valve orifice and seat, the flapper comprising:

a flapper top, the flapper top comprising:
- a captive portion, the captive portion comprising:
  - a first groove; and
  - a polarizing tab defined within the first groove; and
- a peripheral flange extending inwardly about a periphery of the flapper top;

a cone, the cone comprising:
- a top and a bottom;
- a polarizing recess disposed within a rearward portion of an upper cone edge, wherein the polarizing recess receives the polarizing tab of the flapper top such that the cone is non-rotatable and stationary relative to the flapper top;
- a front aperture disposed at an upper cone wall; and
- a bottom aperture disposed in the bottom of the cone, wherein:
  - the bottom aperture has an internal radius and an external radius; and
  - the bottom aperture is disposed at a location offset from the center of the bottom of the cone and at a rearward facing portion of the bottom of the cone, such that the bottom aperture is disposed opposite the front aperture;

a vent band disposed toward the top of the cone, wherein:
- the vent band is attached to the top of the cone such that the vent band is rotatable relative to the cone and to the flapper top; and
- the vent band includes a plurality of support ribs extending radially outwardly therefrom; and a snap-fit cup-like adjuster coupled to the bottom of the cone at a flanged finger extending downwardly from the cone wall such that the adjuster is rotatable relative to the cone and to the flapper top via at least one integrally-formed tactile member extending downwardly from a bottom surface of the adjuster, wherein:
- the snap-fit cup-like adjuster further comprises a plurality of variably sized apertures defined in a bottom portion of the adjuster; and each aperture of the plurality of apertures has an internal radius and an external radius.

2. The flapper of claim 1, wherein the flapper top is made from an elastomeric material.

3. The flapper of claim 2, wherein the elastomeric material comprises an additive that results in the flapper top being resistant to chemicals.

4. The flapper of claim 1, wherein the flapper top comprises an annular peripheral lip having an underside that sealingly mates with the seat of the flush valve orifice.

5. The flapper of claim 4 wherein:

the flapper top further comprises an underside including a captive portion; and the captive portion has a circumferential first groove and a circumferential second groove.

6. The flapper of claim 5, wherein:

the first groove is configured to receive a portion of the cone; and the second groove is configured to receive a portion of the vent band.

7. The flapper of claim 6, wherein the cone comprises a cup-like structure defining a hollow cone cavity.

8. The flapper of claim 7, wherein the cone further comprises a substantially planer upper cone edge that is captured within the first groove of the captive portion of the flapper top.

9. The flapper of claim 6 wherein the cone further comprises:

an upper cone wall having an outer surface;

a central cone wall having an outer surface;

a lower cone wall portion having a recessed outer surface; and a flanged lower cone wall finger extending downwardly from the outer surface of the recessed lower cone wall portion.

10. The flapper of claim 9, wherein the cone further comprises a plurality of cone snap tabs extending outwardly from the outer surface of the upper cone wall to retain the vent band in a vertical position relative to the upper cone wall.

11. The flapper of claim 9, wherein:

the upper cone wall comprises a front aperture; and the vent band comprises an aperture that can be positioned in alignment with the front aperture.

12. The flapper of claim 9, wherein:

the band further comprises a detent disposed within its inner surface; and the cone further comprises a nub to couple with the detent such that the band is able to cog to a position.

13. The flapper of claim 9, wherein the adjuster further comprises:

a bottom portion; and an upwardly-extending circumferential shallow side wall.

14. The flapper of claim 13, wherein the cone further comprises a finger that is attachable to the adjuster via an aperture defined within the bottom portion of the adjuster.

15. The flapper of claim 14, wherein the adjuster apertures can be positioned in alignment with the aperture defined in the bottom portion of the cone.

16. The flapper of claim 15, wherein the aperture defined in the bottom portion of the cone comprises an internal radius for improved water drainage.

17. The flapper of claim 15, wherein the cone and the adjuster comprise locating indicia for a user.

18. The flapper of claim 17, wherein:

the adjuster further comprises a detent disposed within its inner surface; and the cone further comprises a nub to couple with the detent of the adjuster such that the band may be moved into a position correlating with the locating indicia.

* * * * *